US008643313B2

(12) United States Patent
Larsson

(10) Patent No.: US 8,643,313 B2
(45) Date of Patent: Feb. 4, 2014

(54) CYCLOTRON ACTUATOR USING A SHAPE MEMORY ALLOY

(75) Inventor: Johan Larsson, Uppsala (SE)

(73) Assignee: General Electric Company, Schenectady, NY (US)

( * ) Notice: Subject to any disclaimer, the term of this patent is extended or adjusted under 35 U.S.C. 154(b) by 151 days.

(21) Appl. No.: 13/339,724

(22) Filed: Dec. 29, 2011

(65) Prior Publication Data

US 2013/0169194 A1 Jul. 4, 2013

(51) Int. Cl.
*H05H 13/00* (2006.01)

(52) U.S. Cl.
USPC ..... 315/502; 315/500; 315/501; 315/505; 315/506; 315/504

(58) Field of Classification Search
USPC ..... 315/502, 500, 50, 5.43; 250/396 R; 118/500, 728
See application file for complete search history.

(56) References Cited

U.S. PATENT DOCUMENTS 5,669,977 A * 9/1997 Shufflebotham et al. ..... 118/728
5,796,066 A * 8/1998 Guyot ..... 219/121.48
7,448,411 B2 * 11/2008 Friedman et al. ..... 137/625.48
7,688,168 B2 * 3/2010 Taya et al. ..... 335/215
7,694,290 B2 4/2010 Liu et al.
7,710,766 B2 * 5/2010 Mullner et al. ..... 365/157
7,817,030 B2 * 10/2010 Hood et al. ..... 340/539.12
8,154,001 B2 * 4/2012 Flynn et al. ..... 250/505.1
8,378,311 B2 * 2/2013 Balakin ..... 250/396 R
8,436,327 B2 * 5/2013 Balakin ..... 250/492.3
2006/0046564 A1 * 3/2006 Stanford et al. ..... 439/578
2012/0161672 A1 * 6/2012 Cleland et al. ..... 315/502

OTHER PUBLICATIONS

Verzilov, Cameron, Gray, Kellog, Minato, Rawnsley. "A Wideband Intercepting Probe for the Triumf Cyclotron". Proceedings of EPAC 2006, Edinburgh, Scotland. pp. 1001-1003.
Verzilov, Cameron, Gray, Kellog, Minato, Rawnsley. "A Wideband Intercepting Probe for the Triumf Cyclotron". Design Note, TRI-DN-06-1. Vancouver, B.C., Canada. Jan. 2006.
Bylinskii et al. "Triumf 500 MEV Cyclotron Refurbishment". 18th International Conference on Cyclotrons and their Applications (Cyclotrons2007), Giardini Naxos, Sep. 30-Oct. 5. TRI-PP-07-30. Nov. 2007.
Istituto Naxionale di Fisica Nucleare, Laboratori Nazionali del Sud. http://www.Ins.infn.it/index.php?option=com_content &view=article&id=76&Itemid=109.

* cited by examiner

*Primary Examiner* — Daniel Cavallari
*Assistant Examiner* — Srinivas Sathiraju
(74) *Attorney, Agent, or Firm* — General Electric Company; Lucas Divine

(57) ABSTRACT

An actuator assembly for use within the vacuum field of a cyclotron, one embodiment of which comprises an interactor which is moveable between a first position and a second position, at least one support structure for supporting the interactor in the first and second positions, a shape memory alloy (SMA) element connected to the interactor and/or support structure and being adapted to exert a force on the interactor and/or support structure so as to urge the interactor from the first position to the second position, an electromagnetic activator operatively associated with the SMA element for causing the element to exert the force when the electromagnetic activator is selectably activated, and a return mechanism operatively connected to the interactor, the support structure and/or the SMA element so as to urge the interactor from the second position to the first position when the electromagnetic activator is deactivated.

29 Claims, 10 Drawing Sheets

CYCLOTRON ACTUATOR USING A SHAPE MEMORY ALLOY

BACKGROUND OF THE INVENTION

The present invention relates generally to actuators for use in cyclotrons, and more particularly to actuators for use in cyclotrons utilizing a Shape Memory Alloy.

A cyclotron is a type of particle accelerator, which is used to accelerate charged particles (e.g., electrons, protons, alpha particles) up to high speed, thereby creating a beam or stream of charged particles. This beam may then be directed at a target made of a given material (e.g., $H_2{}^{18}O$ water or $^{18}O_2$ gas) to produce particle-to-atom collisions in order to create different atoms (e.g., $^{18}F_2$ gas), ions (e.g., $^{18}F^-$) or other particles (e.g., alpha particles). These resulting atoms, ions or particles may then be put to various uses in research or medicine, such as for diagnostic imaging (e.g., positron emission tomography (PET), single photon emission computed tomography (SPECT), etc.) or radiation therapy (e.g., using alpha particles of electrons).

FIGS. 1 and 2 illustrate a conventional cyclotron 10, comprising two opposed "dees" 12/14 situated within a uniform magnetic field 16 created by two opposing magnets 18/20. The dees 12/14 (so called because of their "D" shape) are placed back-to-back with their straight sides 22/24 parallel to one another, but slightly separated in order to form a gap 26 between them. The dees 12/14 are contained within a vacuum field 36 bounded by a vacuum envelope or barrier 38 (which is defined by the interior surface of the pressure vessel 39 that contains the dees). The dees 12/14 are also connected to a radio-frequency (RF) voltage oscillator 28 that applies a rapidly oscillating voltage to the two dees 12/14 such that their polarities oscillate in a rapid and controlled manner. This produces an electric field 29 across the gap 26. Charged particles are injected into the magnetic field region of the first dee 12 at an injection point 30, and the beam of particles bends in a circular, constant-speed path 32 due to the influence of the magnetic field. Once the beam exits the edge 22 of the first dee 12, it continues in a straight path across the gap 26 and accelerates due to the electric field 29 in the gap 26 between the dees 12/14. The accelerated beam then crosses the edge 24 of the second dee 14 and again curves in a constant (but now higher) speed circular path (now also having a larger radius of curvature than before), until it exits the edge 24 of the second dee 14. The particle beam now accelerates in a straight line across the gap 26 again until it crosses the edge 22 of the first dee 12, and the cycle continues. As this process continues, the beam traces out a generally spiral path, getting faster and further from the center of the cyclotron on each successive loop, until it finally exits one of the dees and collides with a target 34.

While the cyclotron 10 is being operated, the magnets 18/20 may need to be monitored and regulated in order to control the magnetic field, and the RF voltage oscillator 28 may also need to be monitored and regulated in order to control the rapidly oscillating electric field. The reason these magnetic and electric fields need to be controlled is to produce a particle beam 32 in an efficient and effective manner. One common approach toward understanding how the beam is behaving is to interrupt the beam from time to time with a probe 40. There are a variety of different types of probes (such as current probes, CCD cameras, deflectors, foil strippers/extraction devices, etc.) which are useful for directly measuring or sensing various beam characteristics, interrupting or deflecting/perturbing the beam so that other devices can measure or sense various beam characteristics, interrupting the beam and stripping away electrons, etc. FIGS. 3 and 4 illustrate one exemplary approach to probe usage in a cyclotron. The probe 40 may be mounted on a shaft 42 which is rotatably supported by one or more supports 44 (shown here fastened to the floor 46 of the cyclotron chamber by two bolts 48). The shaft 42 may be turned by a stepper motor 56 as illustrated in FIG. 3. The probe 40 is typically positioned in either of two positions or orientations: a first standby position 50 in which the probe 40 does not substantially interrupt the beam path 32 (or is substantially parallel with the path 32), and a second operating position 52 in which the probe 40 does interrupt the beam path 32 (or is oriented such that its incident surface 54 is substantially normal or perpendicular to the beam path 32). The two positions 50/52 of the probe 40 may be achieved by a simple rotation of the probe shaft 42 through use of the stepper motor 56. Alternatives to the use of a rotating probe shaft 42 for placing the probe 40 into and out of the beam path 32 include the use of drive screws, trains, slides, linkages and other mechanisms, for causing the probe 40 to be telescoped toward/away from the cyclotron center (i.e., at different radii), rotated into/out of the beam path 32, etc.

In prior art approaches, the rotating shaft 42 or other mechanism for positioning the probe 40 into the beam path 32 requires the use of one or more feed-throughs 58. A feed-through 58 is a structural arrangement that allows one or more components—such as a probe-positioning mechanism, electrical power or signal wires, pneumatic or hydraulic lines, etc.—to be fed through the vacuum envelope 38. The feed-through 58 may comprise an appropriately sized hole in the pressure vessel 39 which is plugged with a vacuum-tight plug 59 through which the probe-positioning shaft 42 and/or other components pass. The pressure vessel 39 is typically made of metal, while the feed-through plug 59 may be made from a variety of materials such as high-density plastics, ceramics, metals, composites, etc. As shown in FIG. 5, a probe-positioning shaft 42 may pass through the wall of the pressure vessel 39, with a plug 59 sealing the hole in the vessel wall 39. In this example, the plug 39 divides the shaft 42 into one portion 42*i* which is inside the vacuum field 36 and another portion 42*e* which is external. The plug 59 not only provides a vacuum-tight seal, but may also provide a cylindrical internal bearing surface against which the shaft 42 or other positioning mechanism may be rotated or translated while maintaining the seal.

However, when utilizing feed-throughs 58 it is often difficult to prevent leaks and maintain an appropriate vacuum within the cyclotron chamber. This is especially true when the component passing through the feed-through is a mechanical moving member, such as a probe-positioning shaft, drive screw, train, slide, linkage or other mechanism as described above and known in the art. Additionally, it is typically not practical to place the stepper motor 56 (or other prior art devices for moving the probe 40 into position) inside the vacuum field 36 (rather than outside as illustrated in FIG. 3), due to electromagnetic interference that may be caused between the stepper motor 56 and the beam 32. It would be desirable, therefore, to provide a solution for moving a probe 40 into position inside the cyclotron's vacuum field 36 which overcomes these shortcomings

SUMMARY OF THE INVENTION

In one embodiment of the invention, there is provided an actuator assembly for use within the vacuum field of a cyclotron, comprising an interactor which is moveable between a first position and a second position, at least one support structure for supporting the interactor in the first and second positions, a shape memory alloy (SMA) element connected to the interactor and/or support structure and being adapted to exert a force on the interactor and/or support structure so as to urge the interactor from the first position to the second position, an electromagnetic activator operatively associated with the SMA element for causing the element to exert the force when the electromagnetic activator is selectably activated, and a return mechanism operatively connected to the interactor, the support structure and/or the SMA element so as to urge the interactor from the second position to the first position when the electromagnetic activator is deactivated.

In another embodiment, there is provided an actuator assembly for use within the vacuum field of a cyclotron, comprising a interactor having a shaft attached thereto, whereby the shaft may be rotated causing the interactor to rotate between a first standby position and a second operating position, at least one support for rotatably supporting the shaft, a shape memory alloy (SMA) element connected to the interactor and/or shaft and being adapted to exert a force on the interactor and/or shaft so as to urge the interactor from the first standby position to the second operating position, an electromagnetic activator operatively associated with the SMA element for causing the element to exert the force when the electromagnetic activator is selectably activated, and a return mechanism operatively connected to the interactor, the shaft and/or the SMA element so as to urge the interactor from the second operating position to the first standby position when the electromagnetic activator is deactivated.

In another embodiment, there is provided a cyclotron, comprising two or more electrically conductive dees arranged so as to provide at least one acceleration gap between adjacent edges of the dees for accelerating charged particles along a beam path, two opposed magnet elements arranged so as to provide a magnetic field permeating the dees, an RF voltage oscillator operatively connected to the dees for imparting a high frequency oscillating voltage difference between the dees, a pressure vessel containing at least the dees and defining a vacuum envelope containing a vacuum field therein, and an actuator assembly. The actuator assembly comprises an interactor which is moveable between a first position and a second position, at least one support structure for supporting the interactor in the first and second positions, a shape memory alloy (SMA) element connected to the interactor and/or the support structure and being adapted to exert a force on the interactor and/or the support structure so as to urge the interactor from the first position to the second position, an electromagnetic activator operatively associated with the SMA element for causing the SMA element to exert the force when the electromagnetic activator is selectably activated, and a return mechanism operatively connected to at least one of the interactor, the support structure and the SMA element so as to urge the interactor from the second position to the first position when the electromagnetic activator is deactivated. The actuator assembly is adapted for mounting and operation within the vacuum field without any portion of the actuator assembly passing through the vacuum envelope.

In any or all of the above embodiments, one or more of the following further descriptions may apply. The interactor may comprise a probe for intercepting, deflecting or interacting with the cyclotron particle beam, and/or an effector for interacting with one or more mechanisms within the cyclotron vacuum field. The interactor may comprise a probe that is capable of directly sensing the cyclotron beam characteristics, an extractor that is capable of stripping away electrons from the cyclotron beam, an electromagnetic deflector which is capable of deflecting the cyclotron beam, and/or an effector which is capable of mechanically interacting with at least one mechanism within the cyclotron vacuum field. The SMA element may be directly or indirectly connected to the probe, extractor, deflector, effector or other type of interactor. The electromagnetic activator may not produce significant electromagnetic interference when activated. The support structure may be adapted for mounting within the vacuum field of a cyclotron. The actuator assembly may be adapted for mounting and operation within the vacuum field of a cyclotron without any portion of the actuator assembly passing through the envelope of the vacuum field. The SMA element may be thermally activatable and the electromagnetic activator may be adapted to provide an electric current through the SMA element. The SMA element may be magnetically activatable and the electromagnetic activator may be a magnetic field generated by the cyclotron. The abovementioned force may be a force of pushing, pulling, cantilevering and/or rotating. The first standby position and the second operating position may be rotationally offset from each other by about 90 degrees. The electromagnetic activator may comprise a connector electroconductively connected to the SMA element. The return mechanism may comprise an elastic element such as a spring, and/or a second SMA element having a second electromagnetic activator operatively associated therewith.

DETAILED DESCRIPTION OF THE INVENTION

Figure 1:
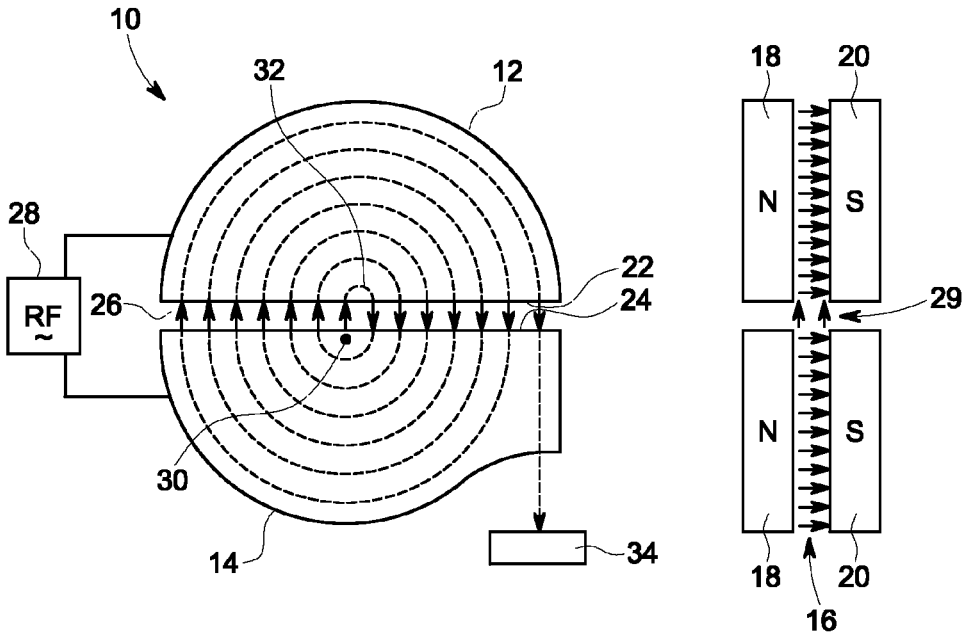
FIG. 1 shows top and side views of a cyclotron.
Figure 2:
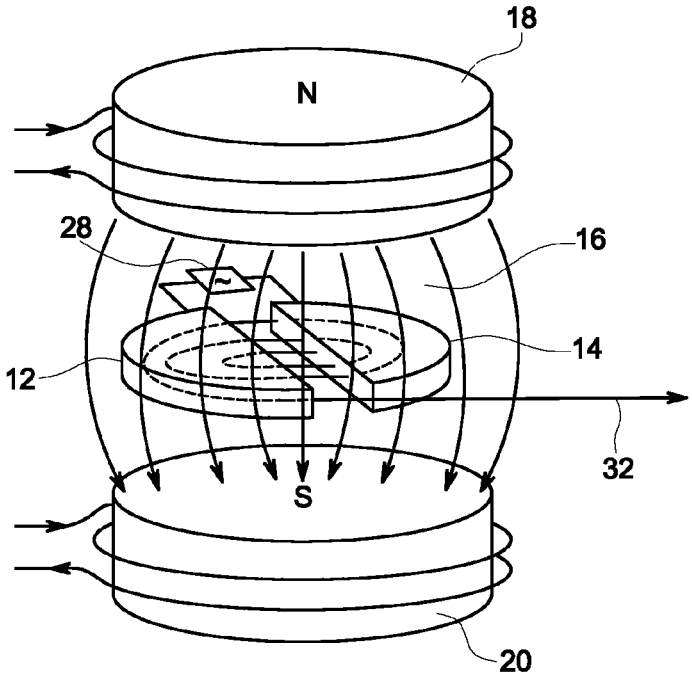
FIG. 2 is a perspective view of a cyclotron.
Figure 3:
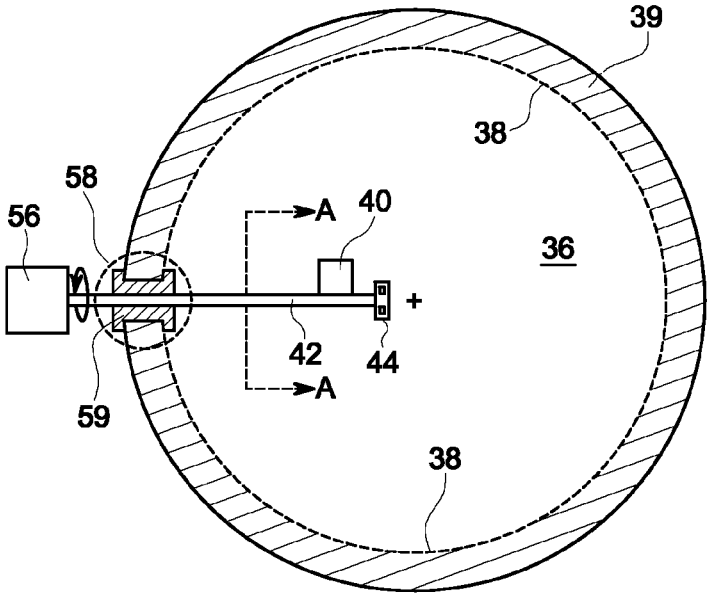
FIG. 3 is a schematic top view of a cyclotron and probe assembly according to the prior art.
Figure 4:
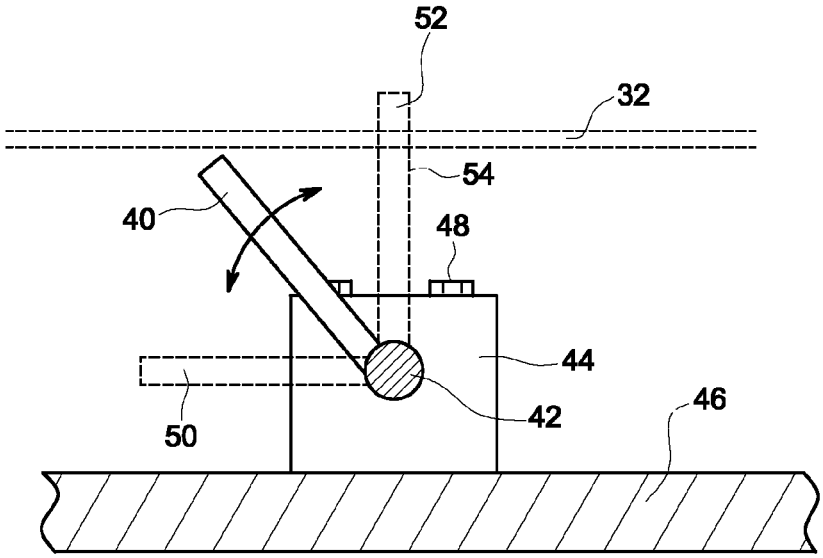
FIG. 4 is a side view of a portion of the probe assembly of FIG. 3 as viewed from line A-A.
Figure 5:
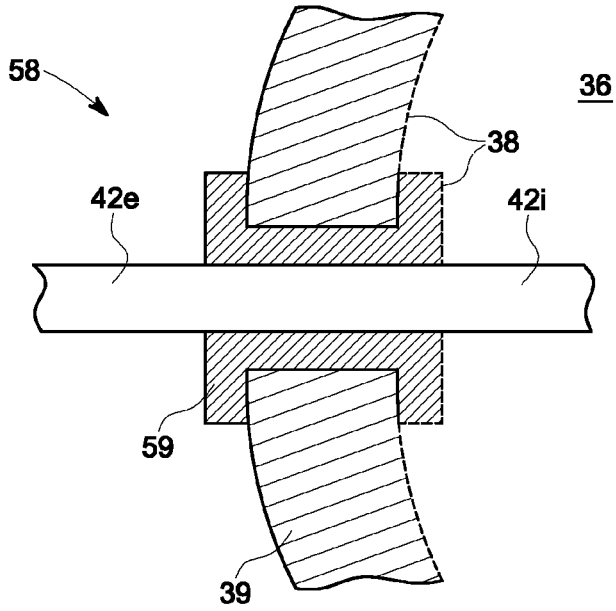
FIG. 5 is an enlarged view of the feed-through shown in FIG. 3.

The foregoing summary, as well as the following detailed description of certain embodiments of the present invention, will be better understood when read in conjunction with the appended drawings. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, any references to a particular embodiment of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments of the invention provide a system and method for actuating an actuator in a cyclotron environment utilizing an SMA. A technical effect of the various embodiments is to provide an actuation system that is configured to perform efficient and effective actuation of an actuator inside a cyclotron in the presence of a vacuum and a strong magnetic field. The system and method are also configured to overcome the drawbacks associated with conventional mechanical, pneumatic, electric motor and other approaches, which tend to create problems with vacuum seals and electromagnetic interference.

To assist the reader in understanding the embodiments of the present invention that are disclosed, all reference numbers used herein are summarized below, along with the elements they represent:

10 Cyclotron
12 First dee
14 Second dee
16 Magnetic field
18 First magnet
20 Second magnet
22 Straight side of first dee
24 Straight side of second dee
26 Gap between the dees
28 RF voltage oscillator
29 Electric accelerating field
30 Injection point
32 Beam path
34 Target
36 Vacuum field
38 Vacuum envelope
39 Pressure vessel/container
40 Probe
42 Shaft
42*e* Exterior portion of shaft (outside the vacuum envelope)
42*i* Interior portion of shaft (inside the vacuum envelope)
44 Support
46 Floor of cyclotron chamber
48 Bolts
50 First stand-by position of the probe
52 Second operating position of the probe
54 Incident surface of the probe
56 Stepper motor
58 Feed-through
59 Plug
60 Actuator assembly
62 Interactor/Probe/Extractor/Deflector/Effector
64 Shaft
66 First stand-by position of the interactor
68 Second operating position of the interactor
70 Support
71 Elongate member of support
73 Cord
72 SMA element
74 Electromagnetic activator
76 Return mechanism
78 Second SMA element
80 Second electromagnetic activator
82 Cyclotron
84 Wires
86 Electrical source
A-H Diagrams showing various interactor movements between positions
$h_{1-6}$ Various heights for the interactor positions/orientations Referring now to the drawings, FIGS. 6-14 show several embodiments of the present invention. In these embodiments there is provided an actuator assembly 60 for use within the vacuum field of a cyclotron, comprising: (a) an interactor 62 which is moveable between a first position 66 and a second position 68; (b) at least one support structure 70 for supporting the interactor in the first and second positions; (c) a shape memory alloy (SMA) element 72 connected to the interactor 62 and/or the support structure 70 and being adapted to exert a force on the interactor 62 and/or support structure 70 so as to urge the interactor 62 from the first position 66 to the second position 68; (d) an electromagnetic activator 74 operatively associated with the SMA element 72 for causing the element 72 to exert the force when the electromagnetic activator 74 is selectably activated; and (e) a return mechanism 76 operatively connected to the interactor 62, the support structure 70 and/or the SMA element 72 so as to urge the interactor 62 from the second 68 position to the first position 66 when the electromagnetic activator 74 is deactivated.

The interactor 62 may comprise a probe which is capable of intercepting, deflecting or interacting with the beam 32, and/or an effector which is capable of interacting with one or more mechanisms within the vacuum field 36. For example, the interactor 62 may be a probe or device which intercepts the beam path 32 when the probe is moved into one of the two positions (e.g., the second/operating position 68), such as a probe that is capable of sensing certain characteristics (e.g., current, energy, speed) of the accelerated particles in the beam path 32, such as a current probe, CCD probe, etc. The interactor 62 may also be a probe or device that intercepts the beam path and strips away electrons from the particles in the beam path (thereby creating protons, deuterons, alpha particles, etc.), such as an extraction/stripper foil made of carbon, tantalum, Havar® or other materials known to those in the art. The interactor 62 may also be an electromagnetic deflector which is positionable so as to intercept or lie near the beam path 32, and which is capable of deflecting or bending the beam path, such as an electrostatic deflector. The interactor 62 may also be an effector which is capable of interacting (mechanically or otherwise) with one or more mechanisms within the cyclotron vacuum field 36 when the effector 62 is moved into at least one of the two positions 66/68. For example, the effector 62 may be an end effector which makes physical/tactile contact with one or more mechanisms or devices, such as switches, levers, cams, slides, latches, releases, spools, take-ups, toggles, retractors, linkages, etc. The mechanism(s) may be separate from/unattached to the effector, or may be connected to the effector, and the interaction may include touching, pushing, pulling, approaching, switching, latching, levering, activating, deactivating, and the like.

The first position 66 may be a "standby" position or orientation of the interactor 62 in which the interactor 62 does not significantly intercept, deflect or interact with the beam path 32, while the second position 68 may be an "operating" position or orientation of the interactor 62 in which the interactor 62 does significantly intercept, deflect or interact with the beam path 32. These positions 66/68 allow the interactor 62 to be moved into and out of the beam path 32, and/or, away from and near the beam trajectory 32. The first/standby and second/operating positions 66/68 can be selected as desired within the vacuum field 36. For example, a second (operating) position 68 may be selected near the end of the beam's spiral trajectory just before it hits the target 34, or it may be selected more toward the center of the spiral path such as near the injection point, or at any other desired point of interception within the vacuum field 36. The first (standby) position 66 can then be selected near the second (operating) position 68 but away from the beam path 32. Or, in the case where the interactor 62 may be an effector (e.g., an end effector that interacts with a positioning linkage of a sensor within the vacuum field), it may be the case that neither of the first and second positions 66/68 of the effector 62 are in or near the beam path 32. So, as used in this specification, although the words "first" and "second" are sometimes used interchangeably with the words "standby" and "operating", respectively, to describe the positions 66/68 of the interactor 62, especially where the first/standby position 66 may be relatively distal from the beam path 32 and the second/operating position 68 may intercept or be proximate to the beam path 32, it is not required that this be the case necessarily.

The support structure 70 may be any suitable structure which supports the interactor 62, either directly or indirectly, for movement between the first and second positions 66/68. The support 70 may include adaptations (e.g., bolt holes, pins, etc.) for allowing the support 70 to be fastened to the floor 46 or other structures within the vacuum field 38/vacuum chamber 39. As illustrated in FIGS. 6-12, the support structure 70 can permit the interactor 62 to be moved between the two positions 66/68 in a variety of orientations as needed. For example, the structure 70 may support the interactor 62 for generally linear movement, such as horizontal movement (e.g., radially toward/away from the chamber's center, as indicated by diagram A in FIG. 11, or oblique to the radial direction as in diagram B), vertical movement (e.g., diagram C), or both (e.g., diagrams D and E). As shown in FIG. 11, diagrams A and B illustrate the movement of the interactor 62 along a generally straight line between two positions 66/68 that are both at the same height $h_1$ with respect to the chamber floor 46; this kind of movement can be accomplished by the arrangement shown in FIG. 6. Diagrams C-E illustrate the movement of the interactor 62 along a generally straight line between two positions 66/68 that are at two different heights $h_2/h_3$. The generally vertical movement represented by diagram C can be accomplished by the arrangement shown in FIG. 7, whereas the generally ramped movement represented by diagrams D and E can be accomplished by the arrangement shown in FIG. 8. The movement in diagram A is shown as being along the x-direction, in diagram B along the y-direction, in diagram C along the z-direction, in diagram D along both the y- and z-directions, and in diagram E in all three directions.

Figure 12:
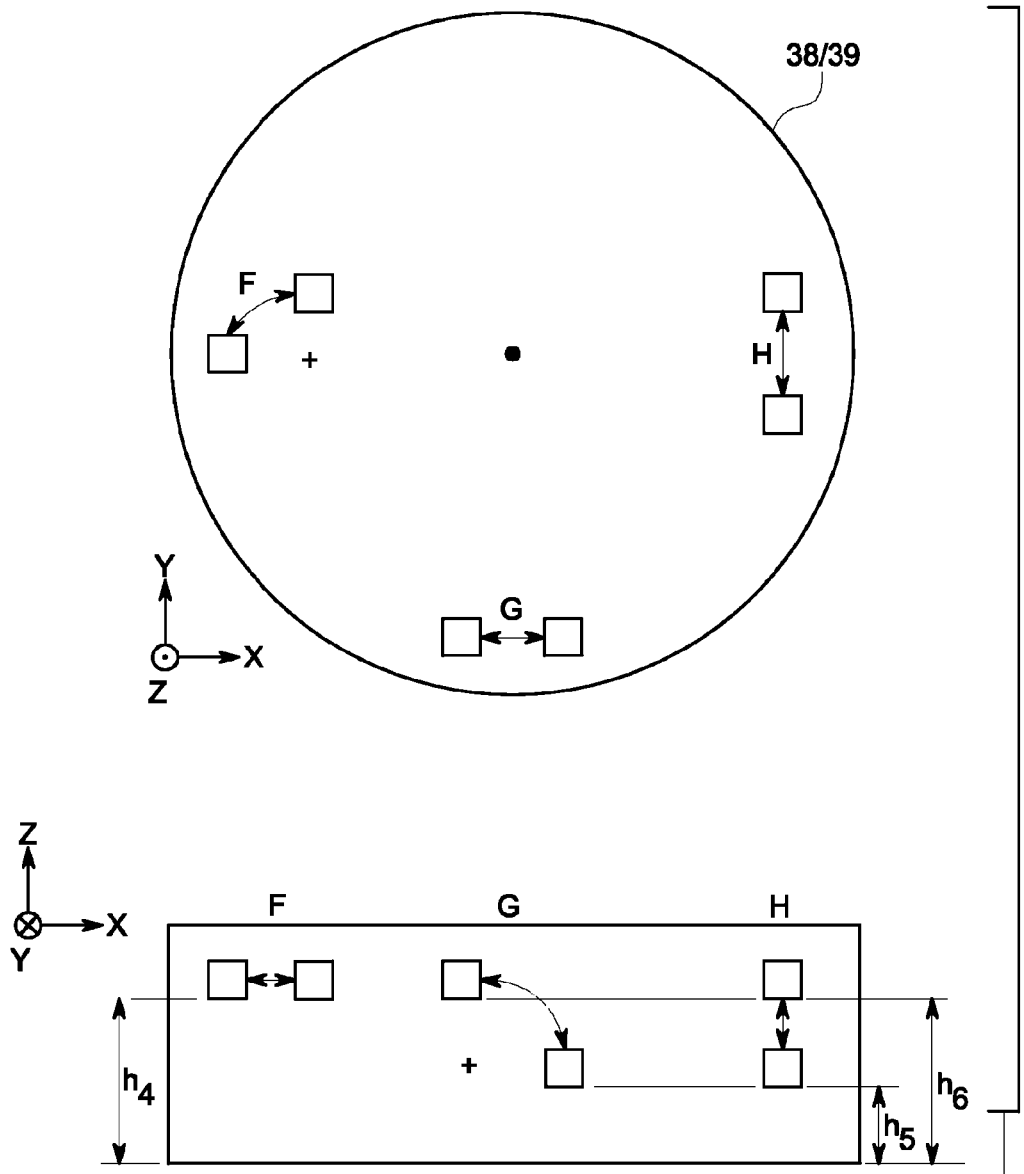
FIG. 12 shows top and side schematic views of various first and second position pairings which provide for substantially rotational/curvilinear interactor movement according to several embodiments of the present invention.

As an alternative to generally linear movements, the position pairings shown by diagrams F-H of FIG. 12 illustrate the movement of the interactor 62 along a generally curvilinear path between the two positions 66/68. Diagram F shows a curvilinear or rotational path between two positions that are both at the same height $h_4$; this kind of movement can be accomplished by the arrangement shown in FIG. 10, in which the rotation or curvilinear motion occurs in a plane generally parallel to the floor 46 or mounting surface. Diagrams G and H show a curvilinear or rotational path between two positions that are at two different heights $h_5/h_6$, which can be accomplished by the arrangement shown in FIG. 9. The centers of rotation of the paths shown in diagrams F and G are indicated by "plus" marks (+) in the top and side views, respectively, of FIG. 12. That is, the movements in diagrams F and G are about axes in the z- and y-directions, respectively. Diagram H illustrates a rotation or curvilinear path that occurs about an axis in the x-direction. If a curvilinear or rotational path is desired, the first and second positions 66/68 may be rotationally offset from each other by about 90 degrees, or by any other suitable angle.

Note that in diagrams A-H, the two interactor positions—i.e., the first/standby position 66 and the second/operating position 68—have not been labeled in FIGS. 11-12 using the reference numerals 66 or 68. Instead, in each diagram the two positions 66/68 have been represented by two small squares connected by double-ended arrows. This is because either of the two small squares can be a first/standby position 66, with its accompanying square being the associated second/operating position 68, depending on the layout and dimensions of the cyclotron in which the actuator assembly 60 is installed and where it is desired to intercept, deflect or interact with the beam path, and/or interact with other mechanisms in the vacuum field 36.

Figure 6:
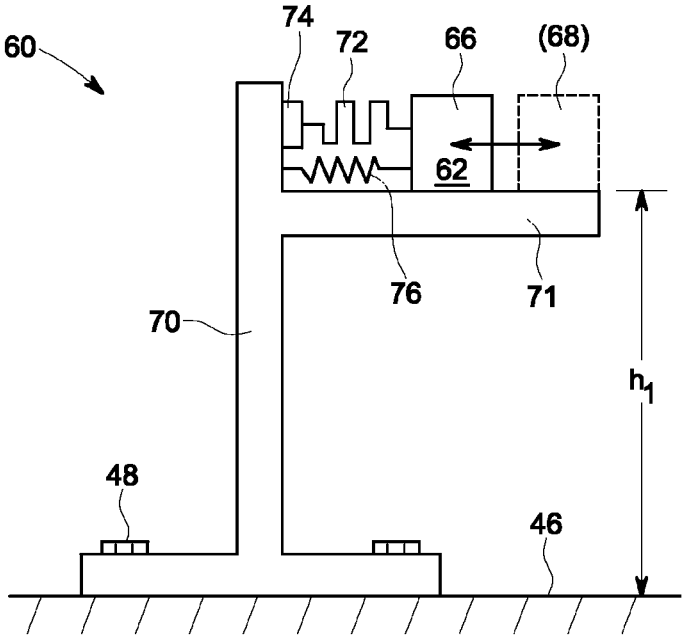
FIG. 6 is a schematic side view of an embodiment of the present invention which provides for substantially horizontal linear interactor movement.
Figure 7:
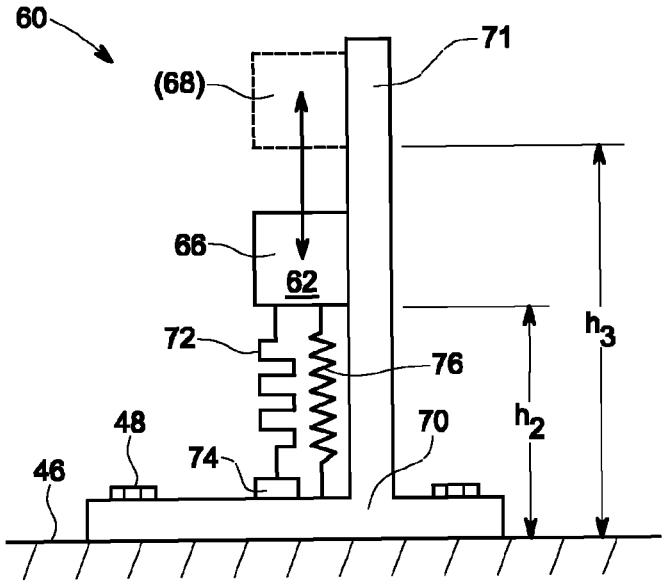
FIG. 7 is a schematic side view of an embodiment of the present invention which provides for substantially vertical linear interactor movement.
Figure 8:
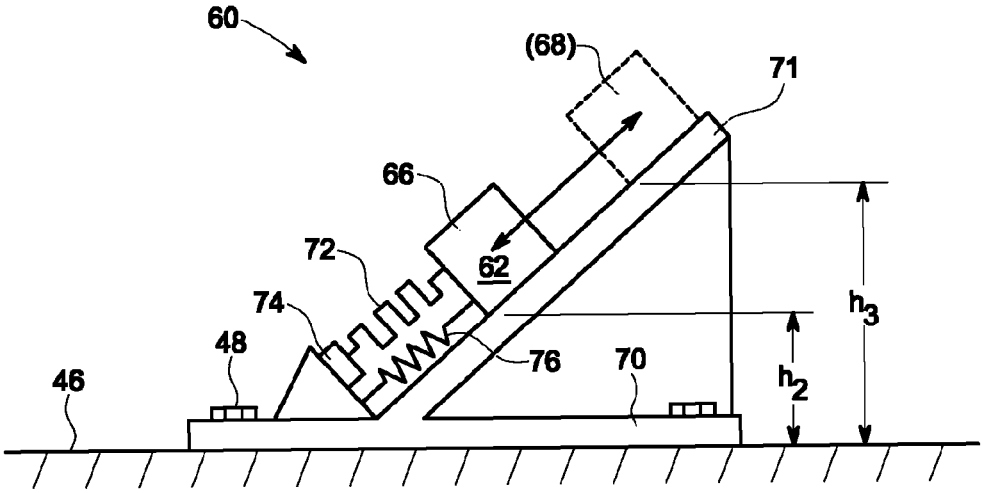
FIG. 8 is a schematic side view of an embodiment of the present invention which provides for ramped linear interactor movement.

In FIGS. 6-8 which are schematic representations, it appears as if the interactor 62 is sliding on an external surface of an elongate member 71 of the support 70. However, it is also possible that the elongate member 71 runs above, beside and/or through the interactor 62, and may comprise two or more elongate elements (e.g., rods, sliding/guiding mechanisms, etc.). Additionally, although the elongate member 71 is illustrated in FIGS. 6-8 as a simple elongate extension integrally formed with the base of the support 70, the elongate member 71 may comprise bearings, bearing surfaces, slideable connectors, guiding arrangements, sliding capture arrangements, telescoping mechanisms, etc. (not shown, but well known to those skilled in the art).

Figure 9:
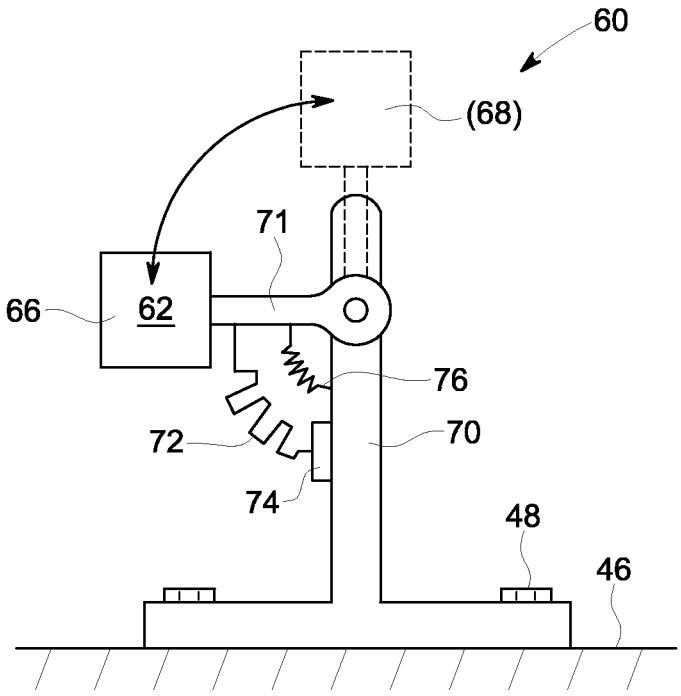
FIG. 9 is a schematic side view of an embodiment of the present invention which provides for rotational interactor movement.
Figure 10:
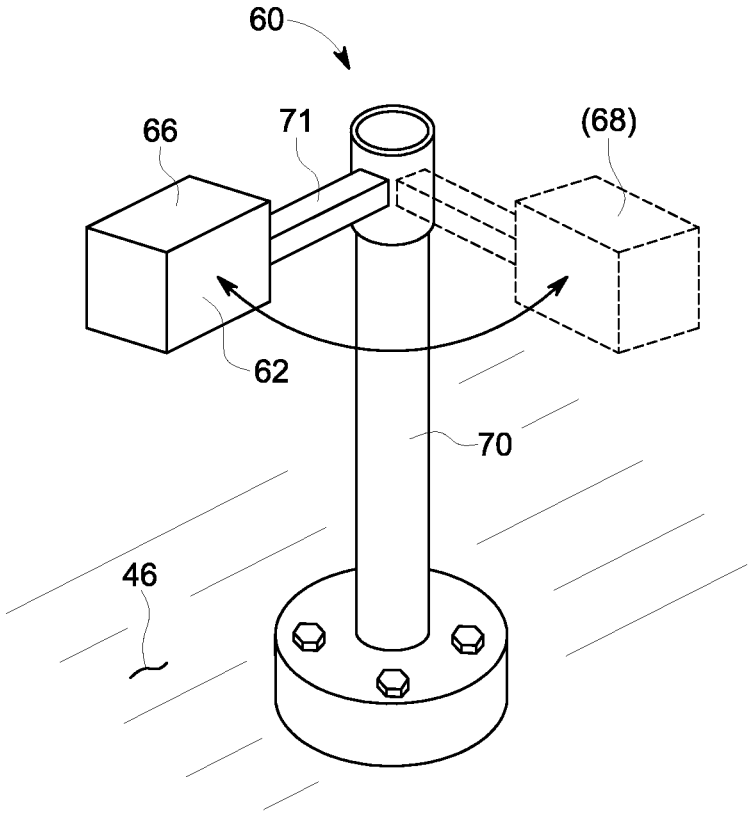
FIG. 10 is a perspective view of an embodiment of the present invention which provides for rotational interactor movement.
Figure 11:
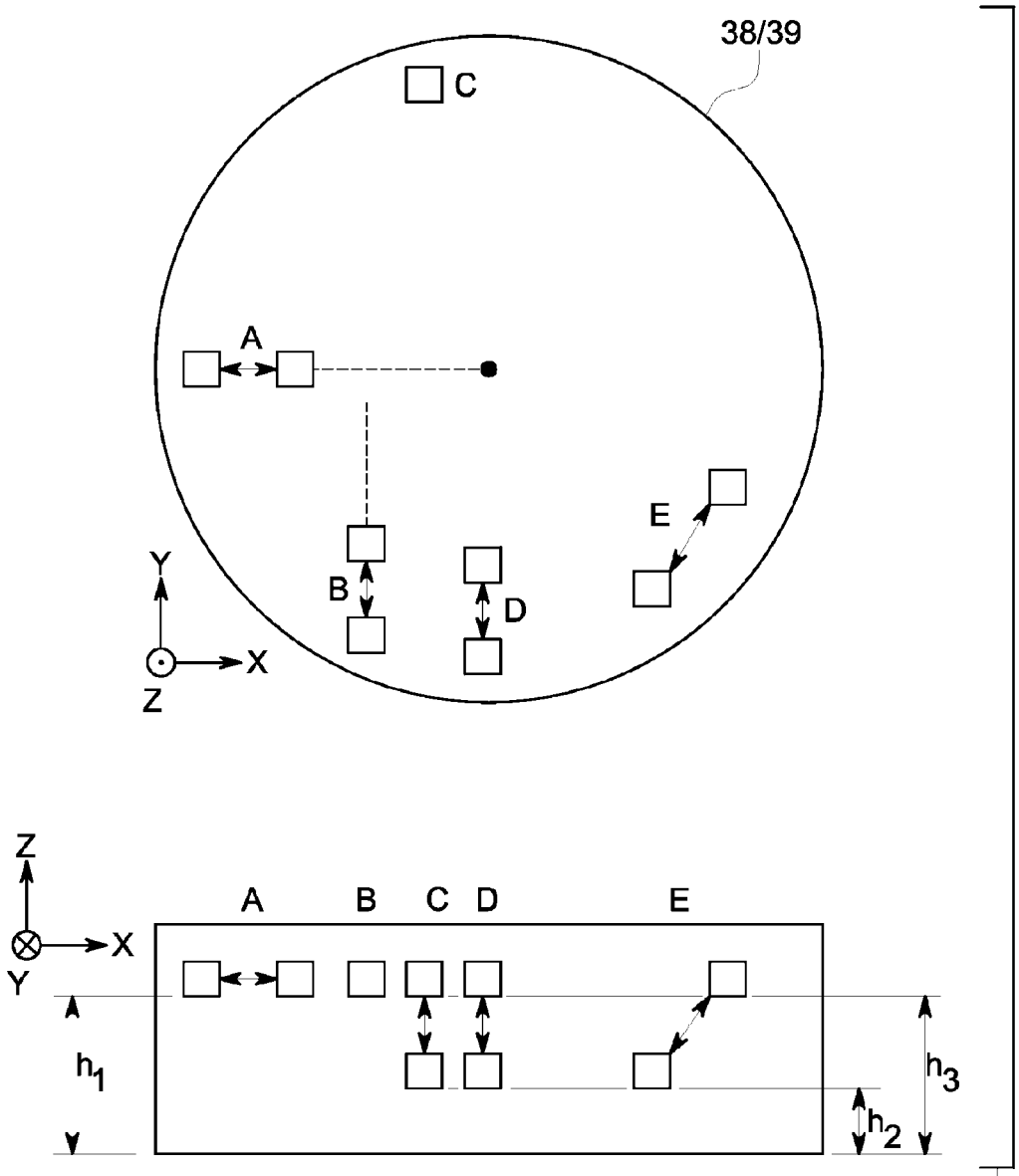
FIG. 11 shows top and side schematic views of various first and second position pairings which provide for substantially linear interactor movement according to several embodiments of the present invention.

In FIGS. 9-10, the interactor 62 is represented as being cantilevered at the end of an elongate beam-like member 71 which is rotated about the support 70. However, the elongate member 71 (or other portion of the support 70 which supports and/or guides the interactor 62 in and between the first and second positions 66/68) may assume various other configurations, such as drums, wheels and the like (not shown, but well known to those skilled in the art). Note that FIG. 10 illustrates a type of curvilinear or rotational motion between the two positions 66/68 that occurs in a plane parallel to the floor 46 or mounting surface; however, it does not explicitly show the placement of the SMA element 72, electromagnetic activator 74 or return mechanism 76 (which may be arranged according to one or more of the arrangements 72/74/76 described in the other embodiments).

The SMA element 72 may be connected to the interactor 62 directly, or indirectly by being connected to the support structure 70 (including guiding/supporting structure that may be part of the support 70), or both. The element 72 may be made of any suitable shape memory alloy (also called memory metal, smart metal, muscle wire and the like) such as nickel-titanium, copper-aluminum-nickel and copper-zinc-aluminum-nickel. An SMA is an alloy which "remember" its original, cold-forged shape, and which returns to its pre-deformed shape by heating, such as by being directly heated or having an electric current pass through it, or (as in the case of a ferromagnetic shape memory alloy) by being activated by a strong magnetic field. The SMA element 72 may be formed in a wide variety of shapes, such as ones that look like tension/ compression springs, torsional/clock springs, leaf springs, etc. The SMA element 72 may be adapted by using known SMA forming techniques so it may exert a force on the interactor 62 and/or the support 70 so as to urge the interactor 62 from the first position 66 to the second position 68. This exertion of force by the SMA element 72 is caused by activation of the electromagnetic activator 74, which is operatively associated with the SMA element 72. The force exerted by the SMA element 72 may be a force of pushing, pulling, cantilevering and/or rotating, due to the element 72 lengthening, shortening and/or otherwise contorting under the influence of the electromagnetic activator 74. If the SMA element 72 is made of a thermally activatable SMA material, then the electromagnetic activator 74 may be adapted to provide an electric current through or immediately adjacent to the SMA element 72. In this case, the electromagnetic activator 74 may be a wire, electrical connector or connection point, or other element connected directly (electroconductively) or indirectly (radiantly or thermoconductively) to the SMA element so as to be capable of conveying heat or an electric current to the element 72. Or, if the SMA element 72 is magnetically activatable, the electromagnetic activator 74 may comprise the strong magnetic field which the cyclotron itself generates while in operation. In this case, the SMA element 72 is urged to exert a force and move the interactor 62 into its second/operating position 68 when the magnetic field generated by the cyclotron is sufficiently strong. Alternatively, the electromagnetic activator 74 may be a component (e.g., an electromagnet) placed suitably near the magnetically activatable SMA element 72 so as to create a magnetic field strong enough to activate the element 72, but not produce significant electromagnetic interference with the beam when activated.

The return mechanism 76 may be operatively connected to the interactor 62, the support structure 70 and/or to the SMA element 72. It may comprise one or more springs or other elastic elements (e.g., clock springs, leaf springs, linear extension/compression springs, stretchable/compressible materials, etc.) or other mechanisms, and acts to urge the interactor 62 from the second/operating position 68 in which the interactor 62 may intercept the beam path 32 back to the first/standby position 66 which may be substantially out of the beam path 32, when the electromagnetic activator 74 is deactivated.

Figure 13A:
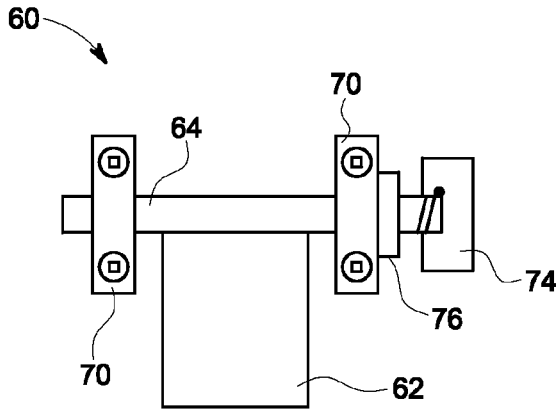
FIG. 13 shows top, front and side schematic views of an embodiment of the present invention which provides for rotation of the interactor about a shaft to which the interactor is attached, shown disposed in a first position.
Figure 13B:
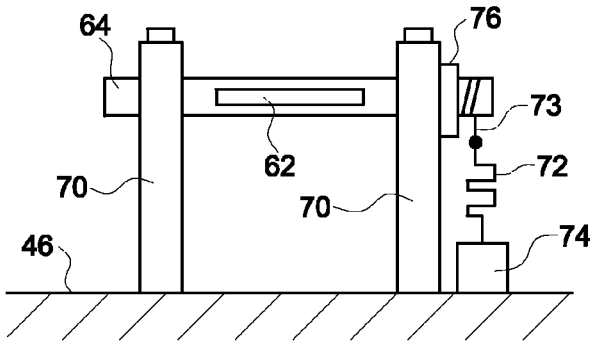
Figure 13C:
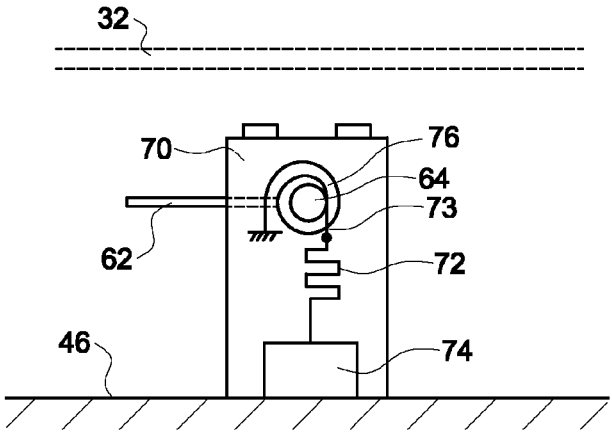
Figure 14A:
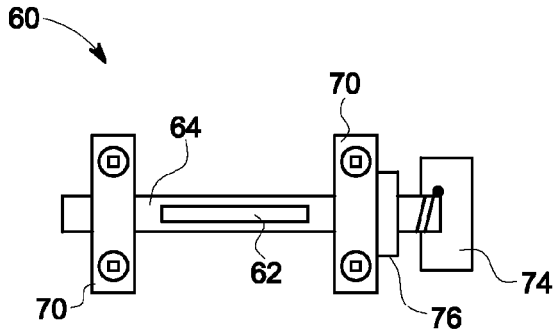
FIG. 14 shows the respective views of FIG. 13, shown disposed in a second position.
Figure 14B:
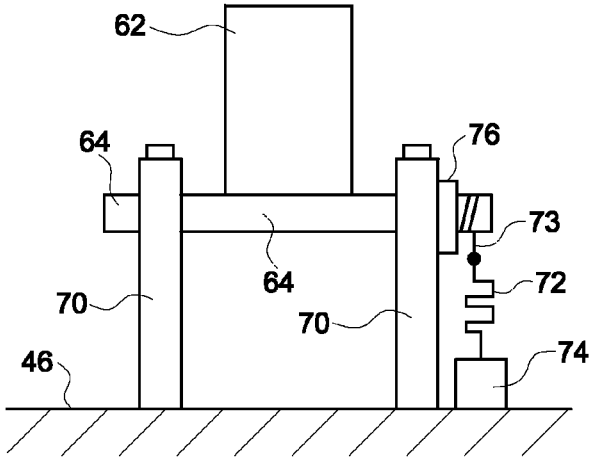
Figure 14C:
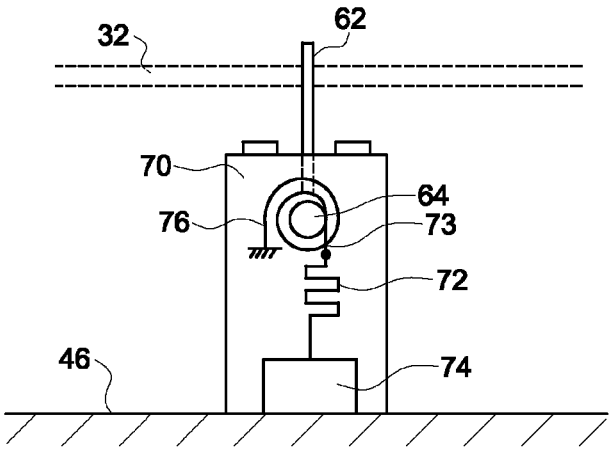

Referring now to FIGS. 13-14, another embodiment of the present invention is shown. In this embodiment there is provided an actuator assembly 60 for use within the vacuum field of a cyclotron, comprising: (a) an interactor 62 having a shaft 64 attached thereto, whereby the shaft 64 may be rotated causing the interactor 62 to rotate between a first standby position 66 and a second operating position 68; (b) at least one support 70 for rotatably supporting the shaft 64; (c) a shape memory alloy (SMA) element 72 connected to the interactor 62 and/or the shaft 64 and being adapted to exert a force on the interactor 62 and/or the shaft 64 so as to urge the interactor 62 from the first standby position 66 to the second operating position 68; (d) an electromagnetic activator 74 operatively associated with the SMA element 72 for causing the element 72 to exert the force when the activator 74 is selectably activated; and (e) a return mechanism 76 operatively connected to the interactor 62, the shaft 64 and/or the SMA element 72 so as to urge the interactor 62 from the second operating position 68 to the first standby position 66 when the electromagnetic activator 74 is deactivated. The return mechanism 76 may also comprise a second SMA element 78 having a second electromagnetic activator 80 operatively associated therewith. The second SMA element 78 may be of the same type as the (first) SMA element 72 (e.g., thermally activatable or magnetically activatable), or it may be of a different type. Likewise, the second electromagnetic activator 80 may be of the same type as the (first) electromagnetic activator 74 (e.g., an electrical connector or the cyclotron's magnetic field), or it may be of a different type. It is also possible that a single electromagnetic activator may act simultaneously (albeit differently) on two SMA elements—one element 72 which moves the interactor 62 from the first position 66 to the second position 68 due to the activation of the electromagnetic activator, and another element 78 which moves the interactor 62 from the second position 68 to the first position 66 due to the deactivation of the activator.

The illustrations shown at the top, middle and bottom of FIGS. 13 and 14, labeled (a), (b) and (c) respectively, show the top view, front view and side view, respectively, of the abovementioned embodiment of the actuator assembly 60, with FIG. 13 illustrating the views in the first standby position 66 and with FIG. 14 illustrating the views in the second operating position 68. In these views, the interator 62 (illustrated here as a plate) is attached to a shaft 64 which is rotatably supported by two supports 70. Although two supports 70 are shown, only one may be required, and three or more may also be used. As illustrated in FIGS. 13-14, the SMA element 72 is attached indirectly to the shaft 64 by means of a cord 73 which is wrapped around and secured to the end of the shaft 64 extending out of one of the supports 70. The return mechanism 76, illustrated here as a torsional clock spring, is likewise attached to the same end of the shaft 64 which extends out of the support 70, with one end of the spring 76 being wound around and attached to the shaft 64 and the other end attached to the support 70. Alternatively, the spring/return mechanism 76 could be attached to the other end of the shaft 64 which extends beyond the other support 70, or it could be attached to the shaft 64 and/or the interactor 62 somewhere between the two supports 70. Also, it is not required that the SMA element 72 be indirectly attached to the shaft 64 via a cord 73 or other connection means, but instead could be directly attached to the shaft. For example, one end of the SMA element 72 could be formed as a wire which wraps partially or fully around the shaft 64 and is attached to the shaft. When the activating element 74 is activated (e.g., electricity flows to it and on to the SMA element 72), one or more segments of the SMA element 72 may be activated thereby to cause the SMA element to exert linear or rotational force on the shaft 62, thereby causing it to rotate and causing the interactor 62 to be moved from the first position shown in FIG. 13 to the second position shown in FIG. 14. When this movement occurs, the return mechanism 76 will simultaneously be would up, unwound, stretched, compressed or otherwise acted upon so as to cause a change in potential energy therein, For example, the clock spring 76 shown in FIGS. 13-14 would be wound up (storing potential energy) due to the rotation of the shaft 64 caused by the activation and movement of the SMA element 72. When the activating element 74 is deactivated (e.g., electrical flow is discontinued thereto), the SMA element would no longer be activated and the potential energy stored up in the return mechanism 76 would cause the actuator assembly 60 to return to the first position 66.

One application of the abovementioned movement of the interactor 62 between the first and second positions 66/68 is illustrated in FIGS. 13-14, which shows the interactor 62 intercepting the particle beam path 32 within the cyclotron when the actuator assembly 60 is in the second position 68, and not interacting with the beam in the first position 66. Many other applications not illustrated here are also possible, such as the interactor 62 being a probe, extractor, deflector or the like which directly or indirectly interacts with the particle beam 32, or an effector which interacts with other mechanisms, components or structures within the vacuum field 38 of the cyclotron.

Figure 15:
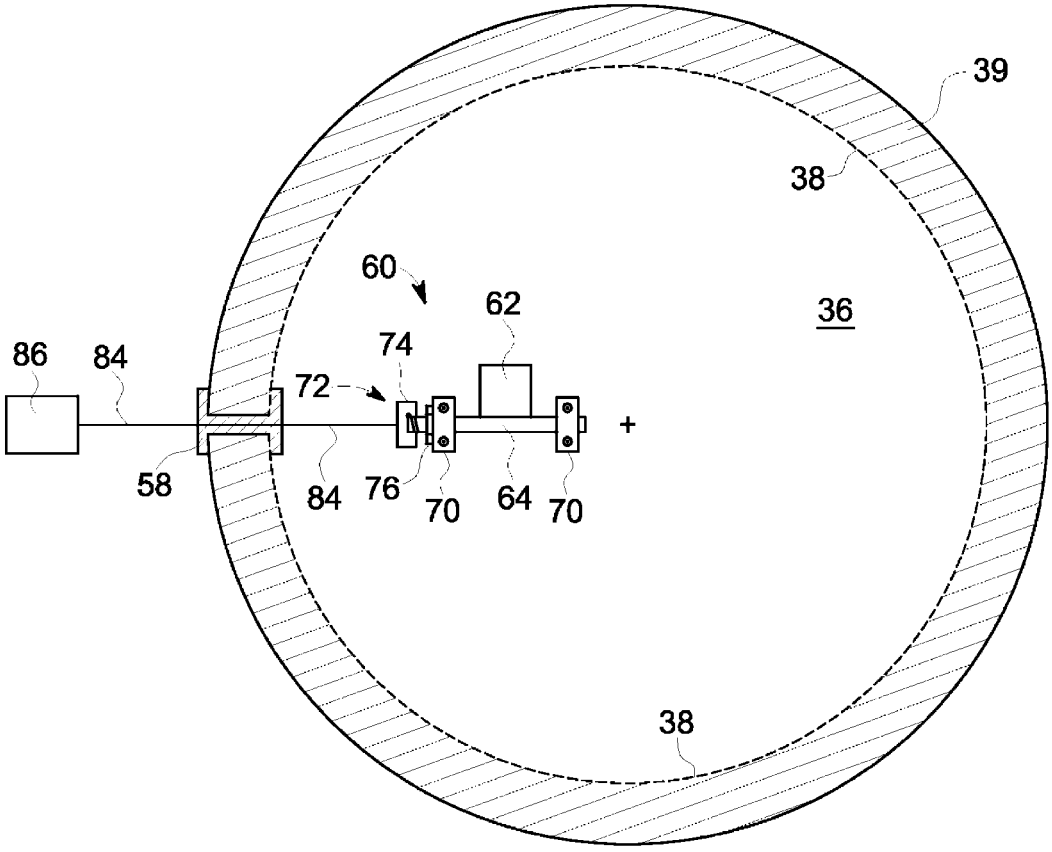
FIG. 15 is a schematic top view of a cyclotron according to an embodiment of the present invention.

Referring now to FIG. 15, yet another embodiment of the present invention is shown. In this embodiment there is provided a cyclotron 82, comprising: (a) two or more electrically conductive dees 12/14 arranged so as to provide at least one acceleration gap 26 between adjacent edges 22/24 of the dees 12/14 for accelerating charged particles along a beam path 32; (b) two opposed magnet elements 18/20 arranged so as to provide a magnetic field 16 permeating the dees 12/14; (c) an RF voltage oscillator 28 operatively connected to the dees 12/14 for imparting a high frequency oscillating voltage difference between the dees 12/14; (d) a pressure vessel 39 containing at least the dees 12/14 and defining a vacuum envelope 38 containing a vacuum field 36 therein; and (e) an actuator assembly 60. The actuator assembly 60 may comprise: (i) an interactor which is moveable between a first position 66 and a second position 68; (ii) at least one support structure 70 for supporting the interactor 62 in the first and second positions 66/68; (iii) a shape memory alloy (SMA) element 72 connected to the interactor 62 and/or the support structure 70 and being adapted to exert a force on the interactor 62 and/or the support structure 70 so as to urge the interactor 62 from the first standby position 66 to the second operating position 68; (iv) an electromagnetic activator 74 operatively associated with the SMA element 72 for causing the SMA element 72 to exert the force when the electromagnetic activator 74 is selectably activated; and (v) a return mechanism 76 operatively connected to at least one of the interactor 62, the support structure 70 and the SMA element 72 so as to urge the interactor 62 from the second position 68 to the first position 66 when the electromagnetic activator 74 is deactivated. In this embodiment, the actuator assembly 60 is adapted for mounting and operation within the vacuum field 36 without any portion of the actuator assembly 60 passing through the vacuum envelope 38. (This may also be a desired aim for any of the embodiments disclosed herein.) As mentioned above, the interactor 62 may comprise a probe or device for intercepting, deflecting or interacting with the cyclotron beam path 32, and/or an effector for mechanically or otherwise interacting with one or more mechanisms, components or structures within the cyclotron vacuum field 36.

FIG. 15 shows one application of an embodiment of the present invention. Here, the actuator assembly 60 illustrated in FIGS. 13-14 is shown affixed within the vacuum field 38 of the cyclotron. The supports 70 are bolted to the floor 46 of the cyclotron chamber, and a wire 84 connected to the SMA activator 74 is shown passing through a very small feed-through 58 in the cyclotron wall 39 and on to an electrical source 86 outside the cyclotron chamber 39. The source 86 can be selectably activated when desired to send an electrical signal through the wire 84 to the SMA activator 74, which in turn will cause a current to flow through the SMA element 72 so as to move the interactor 62 from the first position 66 to the second position 68. The interactor 62 illustrated in FIG. 15 is a plate-shaped probe that is shown in the first/standby position 66, in which the probe/plate 62 lies relatively parallel to the chamber floor 46 and does not intercept the particle beam. One advantage of various embodiments of the present invention is that a very small feed-through 58 can be used to pass the wire 84 through the cyclotron wall 39, which is much smaller than is needed by conventional approaches where shafts or other mechanical components must pass through the cyclotron wall 39. Additionally, with only wires passing through the smaller feed-through 58, there would be no need to provide bearing surfaces in the feed-through to support conventional shafts or other mechanisms, so this greatly minimizes the chances of vacuum leakage as compared to conventional approaches. More than one actuator assembly 60 can be provided within the vacuum field 38, each with its own wire(s) 84 to provide for activation from outside the field 38, and yet all of these wires can be accommodated with a single feed-through 58.

In all of the above embodiments, when the actuator assembly 60 is mounted within the vacuum field 36 of a cyclotron, wires 84 may be passed through a feed-through and connected to the electromagnetic activator 74. These wires 84 can then be selectably energized from outside the vacuum field 36, thereby selectably energizing the electromagnetic activator 74 and selectably causing the SMA element 72 to exert force on the interactor 62 and/or the support structure 70. Additionally, although only two positions 66/68 of the interactor 62 have been described above, it is possible that three or more positions can also be enabled within the scope and spirit of the present invention. For example, an arrangement can be created having one standby position, and two operating positions that intercept the beam at different points (e.g., radii) in the generally spiral beam path. Furthermore, it is also within the scope and spirit of the present invention that the relationship between the first and second positions 66/68 and the activated/deactivated state of the electromagnetic activator 74 may be reversed from the relationship described above. That is, the first/standby position 66 may be achieved when the activator 74 is activated, and the second/operating position 68 may be achieved when the activator 74 is deactivated. In such an arrangement, the return mechanism 76 would be arranged so as to urge the interactor 62 from the first/standby position 66 to the second/operating position 68 when the activator 74 is deactivated. Moreover, while many aspects of the various embodiments have been rendered schematically in the drawings, those skilled in the art will appreciate that these schematic aspects can be physically rendered in many different forms, mechanisms, arrangements and the like.

The above description is intended to be illustrative, and not restrictive. While the invention has been described in terms of various specific embodiments, those skilled in the art will recognize that the invention can be practiced with modification within the spirit and scope of the claims. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to illustrate the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the invention, including the best mode, and also to enable those skilled in the art to practice the invention, including making and using any devices or systems thereof and performing any methods thereof. It is the following claims, including all equivalents, which define the scope of the present invention.

The invention claimed is:

1. An actuator assembly for use within the vacuum field of a cyclotron, comprising:

(a) an interactor which is moveable between a first position and a second position, said interactor comprising (i) a probe for intercepting, deflecting or interacting with the cyclotron particle beam, or (ii) an effector for interacting with one or more mechanisms within the cyclotron vacuum field;

(b) at least one support structure for supporting said interactor in said first and second positions;

(c) a shape memory alloy (SMA) element connected to said interactor or said support structure and being adapted to exert a force on said interactor or said support structure so as to urge said interactor from said first position to said second position;

(d) an electromagnetic activator operatively associated with said SMA element for causing said SMA element to exert said force when said electromagnetic activator is selectably activated; and (e) a return mechanism operatively connected to at least one of said interactor, said support structure and said SMA element so as to urge said interactor from said second position to said first position when said electromagnetic activator is deactivated.

2. An actuator assembly according to claim 1, wherein said SMA element is directly connected to said interactor.

3. An actuator assembly according to claim 1, wherein said SMA element is indirectly connected to said interactor.

4. An actuator assembly according to claim 1, wherein said interactor is a probe which intercepts the cyclotron beam when said probe is moved into said second position.

5. An actuator assembly according to claim 4, wherein said probe is capable of directly sensing the cyclotron beam characteristics when said probe is moved into said second position.

6. An actuator assembly according to claim 4, wherein said probe is an extractor which strips electrons away from the cyclotron beam when said extractor is moved into said second position.

7. An actuator assembly according to claim 1, wherein said interactor is an electromagnetic deflector which deflects the cyclotron beam when said deflector is moved into said second position.

8. An actuator assembly according to claim 1, wherein said interactor is an effector which mechanically interacts with at least one mechanism within the cyclotron vacuum field when said effector is moved into said second position.

9. An actuator assembly according to claim 1, wherein said electromagnetic activator does not produce significant electromagnetic interference when activated.

10. An actuator assembly according to claim 1, wherein said SMA element is thermally activatable and said electromagnetic activator is adapted to provide an electric current through said SMA element.

11. An actuator assembly according to claim 1, wherein said SMA element is magnetically activatable and said electromagnetic activator is a magnetic field generated by the cyclotron.

12. An actuator assembly according to claim 1, wherein said actuator assembly is adapted for mounting and operation within the vacuum field of a cyclotron without any portion of said actuator assembly passing through the envelope of the vacuum field.

13. An actuator assembly according to claim 1, wherein said electromagnetic activator comprises a connector electroconductively connected to said SMA element.

14. An actuator assembly according to claim 1, wherein said return mechanism comprises at least one of (i) an elastic element and (ii) a second SMA element having a second electromagnetic activator operatively associated therewith.

15. An actuator assembly according to claim 1, wherein said interactor further comprises a shaft attached thereto, whereby said shaft may be rotated causing said interactor to rotate between said first position and said second position, and wherein said support structure rotatably supports said shaft.

16. An actuator assembly for use within the vacuum field of a cyclotron, comprising:

(a) an interactor having a shaft attached thereto, whereby said shaft may be rotated causing said interactor to rotate between a first standby position and a second operating position, said interactor comprising (i) a probe for intercepting, deflecting or interacting with the cyclotron particle beam, or (ii) an effector for interacting with one or more mechanisms within the cyclotron vacuum field;

(b) at least one support for rotatably supporting said shaft;

(c) a shape memory alloy (SMA) element connected to said interactor or said shaft and being adapted to exert a force on said interactor or shaft so as to urge said interactor from said first standby position to said second operating position;

(d) an electromagnetic activator operatively associated with said SMA element for causing said SMA element to exert said force when said electromagnetic activator is selectably activated; and (e) a return mechanism operatively connected to at least one of said interactor, said shaft and said SMA element so as to urge said interactor from said second operating position to said first standby position when said electromagnetic activator is deactivated.

17. An actuator assembly according to claim 16, wherein said SMA element is thermally activatable and said electromagnetic activator is adapted to provide an electric current through said SMA element.

18. An actuator assembly according to claim 16, wherein said SMA element is magnetically activatable and said electromagnetic activator is a magnetic field generated by the cyclotron.

19. An actuator assembly according to claim 16, wherein said actuator assembly is adapted for mounting and operation within the vacuum field of a cyclotron without any portion of said actuator assembly passing through the envelope of the vacuum field.

20. An actuator assembly according to claim 16, wherein said electromagnetic activator comprises a connector electroconductively connected to said SMA element.

21. An actuator assembly according to claim 16, wherein said return mechanism comprises at least one of (i) an elastic element and (ii) a second SMA element having a second electromagnetic activator operatively associated therewith.

22. An actuator assembly according to claim 16, wherein said interactor is a probe which intercepts the cyclotron beam when said probe is moved into said second operating position.

23. An actuator assembly according to claim 22, wherein said probe is capable of directly sensing the cyclotron beam characteristics when said probe is moved into said second operating position.

24. An actuator assembly according to claim 22, wherein said probe is an extractor which strips electrons away from the cyclotron beam when said extractor is moved into said second operating position.

25. An actuator assembly according to claim 16, wherein said interactor is an electromagnetic deflector which deflects the cyclotron beam when said deflector is moved into said operating second position.

26. An actuator assembly according to claim 16, wherein said interactor is an effector which mechanically interacts with at least one mechanism within the cyclotron vacuum field when said effector is moved into said second operating position.

27. An actuator assembly according to claim 16, wherein said SMA element is directly connected to said interactor.

28. An actuator assembly according to claim 16, wherein said SMA element is indirectly connected to said interactor.

29. A cyclotron, comprising:

(a) two or more electrically conductive dees arranged so as to provide at least one acceleration gap between adjacent edges of said dees for accelerating charged particles along a beam path;

(b) two opposed magnet elements arranged so as to provide a magnetic field permeating said dees;

(c) an RF voltage oscillator operatively connected to said dees for imparting a high frequency oscillating voltage difference between said dees;

(d) a pressure vessel containing at least said dees and defining a vacuum envelope containing a vacuum field therein; and (e) an actuator assembly, comprising:

(i) an interactor which is moveable between a first position and a second position, said interactor comprising (A) a probe for intercepting, deflecting or interacting with the cyclotron beam path, or (B) an effector for interacting with one or more mechanisms within the vacuum field;

(ii) at least one support structure for supporting said interactor in said first and second positions;

(iii) a shape memory alloy (SMA) element connected to said interactor or said support structure and being adapted to exert a force on said interactor or said support structure so as to urge said interactor from said first position to said second position;

(iv) an electromagnetic activator operatively associated with said SMA element for causing said SMA element to exert said force when said electromagnetic activator is selectably activated; and (v) a return mechanism operatively connected to at least one of said interactor, said support structure and said SMA element so as to urge said interactor from said second position to said first position when said electromagnetic activator is deactivated;

wherein said actuator assembly is adapted for mounting and operation within the vacuum field without any portion of said actuator assembly passing through the vacuum envelope.

* * * * *